US007818955B2

(12) United States Patent
Nilsson

(10) Patent No.: US 7,818,955 B2
(45) Date of Patent: Oct. 26, 2010

(54) FUEL INJECTION SYSTEM AND PURGING METHOD

(75) Inventor: Ulf Erik Nilsson, Whetstone (GB)

(73) Assignee: Alstom Technology Ltd, Baden (CH)

( * ) Notice: Subject to any disclaimer, the term of this patent is extended or adjusted under 35 U.S.C. 154(b) by 956 days.

(21) Appl. No.: 11/346,798

(22) Filed: Feb. 3, 2006

(65) Prior Publication Data

US 2006/0283193 A1 Dec. 21, 2006

(30) Foreign Application Priority Data

Feb. 5, 2005 (GB) ..... 0502438.5

(51) Int. Cl.
*F02G 3/00* (2006.01)

(52) U.S. Cl. ..... 60/39.094; 60/803

(58) Field of Classification Search ..... 60/39.094, 60/772, 734, 803
See application file for complete search history.

(56) References Cited

U.S. PATENT DOCUMENTS 5,417,054 A * 5/1995 Lee et al. ..... 60/39.094
6,121,628 A * 9/2000 Rising ..... 250/573
6,125,624 A 10/2000 Prociw
7,017,609 B2 * 3/2006 Miwa ..... 137/884
7,146,970 B2 * 12/2006 Everingham et al. ..... 123/520
2005/0229677 A1 * 10/2005 Tuller et al. ..... 73/24.01
2006/0114115 A1 * 6/2006 Smith et al. ..... 340/634

FOREIGN PATENT DOCUMENTS

EP 0 724 115 A2 7/1996
EP 1 184 623 A2 3/2002

* cited by examiner

*Primary Examiner*—Michael Cuff
*Assistant Examiner*—Phutthiwat Wongwian
(74) *Attorney, Agent, or Firm*—Kirschstein, et al.

(57) ABSTRACT

A fuel injection system has a fuel lance for supplying gaseous fuel to the burner of a gas turbine engine. The fuel lance includes a gas sensor that is used to monitor the concentration of the methane fuel inside the gas pilot channel of the fuel lance. The invention prevents overheating caused by the ignition of the methane fuel inside the fuel lance by monitoring the concentration of the methane fuel during the purge sequence and taking action if a critical fuel air mixture is reached.

28 Claims, 2 Drawing Sheets

FUEL INJECTION SYSTEM AND PURGING METHOD

FIELD OF THE INVENTION

The present invention relates to a fuel injection system, and in particular to a fuel injection system for supplying gaseous fuel such as methane to a burner or burners that fire into a combustion chamber such as a gas turbine engine or furnace. The present invention also relates to a method of purging the fuel injection system to remove any residual fuel that may be trapped in the fuel injection system.

BACKGROUND OF THE INVENTION

In a fuel injection system having multiple fuel supply components (such as the fuel lances described below), it is sometimes necessary to shut down one or more of the fuel supply components while at least one of the remaining fuel supply components continues to operate. In this case, there is a need to consider purging the fuel supply component or components that have been shut down to remove any residual fuel that may be trapped in the component or components. Otherwise, there is a risk that in some circumstances the residual fuel might mix with air and undergo combustion close to, or within, the fuel supply component or components leading to overheating and damage of the same. Moreover, even in the absence of air, if the residual fuel is subject to elevated temperatures then this can lead to fuel decomposition and the undesirable formation of soot with the potential to block the fuel supply component or components.

In one particular example, a burner is arranged in the plenum of a gas turbine engine and leads with an inner injection space into a combustion chamber. Compressed air is admitted to the burner from the compressor exit plenum of the gas turbine engine. A main fuel supply component of the fuel injection system injects fuel into the air and a fuel lance (sometimes called a pilot fuel lance) is used to periodically supply a gaseous fuel such as methane into the injection space.

The fuel lance has a central bore or passage (normally called the gas pilot channel) for carrying the fuel. In some cases, a number of separate fuel lances are supplied with fuel from a single fuel manifold and a check valve (or non-return valve) prevents the flow of fuel back though the fuel lance and into the fuel manifold. The fuel manifold is supplied with fuel and at least one purge gas such as nitrogen through valves that switch between a fuel supply and a purge gas supply.

There is a risk that ignition of the fuel can take place close to, or inside, the fuel lance under certain conditions. One such condition arises if the fuel lance is not sufficiently purged with nitrogen after a supply of fuel has been completed, or before a supply of fuel is commenced. Another condition arises if fuel trapped in the fuel manifold upstream of the check valve is discharged past the check valve during load decrease driven by the pressure difference between the fuel manifold and the combustion chamber. It will be readily appreciated that both of these conditions depend critically on whether or not the check valve is operating properly and within specified limits.

Because of the risk that the fuel might ignite close to, or inside, the fuel lance, the operating temperature of the fuel lance can be monitored by placing a thermocouple at the tip of the fuel lance and in the gas pilot channel near the outlet of the check valve. However, in practice the use of thermocouples is not entirely satisfactory. First of all, the thermocouples only detect overheating local to the thermocouple and significant damage to the fuel lance can occur before the overheating is detected. The output signals from the thermocouples are not reliable and can cause restriction in the operation of the gas turbine engine. The location of the thermocouples also makes it difficult to access them for maintenance and repair.

Accordingly, there is a need for an improved fuel injection system with means for allowing the effectiveness of any purge sequence and/or the operating condition of the fuel injection system and the check valve to be monitored in a reliable way so that overheating can be prevented.

SUMMARY OF THE INVENTION

The present invention therefore provides a fuel injection system comprising a fuel supply component that undergoes a purge sequence, and a gas sensor for detecting the concentration of the gaseous fuel inside the fuel supply component.

The fuel supply component may, for example, be a fuel lance connectable to a supply of gaseous fuel through a check valve for preventing reverse flow of the gaseous fuel. The fuel lance may have a gas channel through which the gaseous fuel is supplied. In this case, the sensor can be located in the gas channel adjacent to, or in close proximity to, the check valve.

One example of a situation where the fuel injection system may be used is in a gas turbine engine where the fuel supply component supplies gaseous fuel to a burner. However, it will be readily appreciated that the fuel injection system according to the present invention can be used for any gaseous combustion supply that requires a fuel purge.

By detecting the concentration of the fuel inside the fuel supply component, it is possible to get an early indication that a critical fuel air mixture has been reached, or is likely to be reached. Steps can then be taken to reduce the risk of ignition by reducing the concentration of the fuel inside the fuel supply component, or by controlling the operation of the fuel injection system.

Even when the fuel injection system is operating normally, the concentration of the fuel inside the fuel supply component can be used to control the timing and duration of the purge sequence and the flow of fuel through the fuel supply component to make sure that the fuel supply component has been properly purged. For example, the purge sequence can be extended only until such time as the fuel concentration inside the fuel supply component has fallen below a predetermined level where the risk of ignition is assumed to be low.

At present it is normal for gas turbine engines, for example, to use a fixed purge sequence that relies on a predetermined volume of purge gas passing through the fuel distribution system. To ensure adequate purging, the time over which the purge sequence takes place may normally be longer than is strictly necessary. In addition to identifying fault condition, the fuel injection system of the present invention can therefore be used to reduce the amount of purge gas that is used during the purge sequence to a minimum while still maintaining adequate purging.

The gas sensor can also detect the concentration of any other gases inside the fuel supply component such as air and the nitrogen introduced during the purge sequence, for example.

The gas sensor is preferably connected to an electronic device that can monitor the concentration of the gaseous fuel inside the fuel supply component. More particularly, the electronic device can compile, process and store the output signals provided by the gas sensor. The electronic device can also provide a warning notification (in the form of a control signal or an audible or visual alarm, for example) if the concentration of the fuel in the fuel supply component exceeds a predetermined level where the risk of ignition is assumed to be high. In certain circumstances, the device can control the operation of the fuel injection system and in particular the timing and duration of the purge sequence. The concentration of fuel inside the fuel supply component can be monitored continuously during operation of the fuel injection system. Alternatively, the monitoring can take place at regular intervals or at certain predetermined times, such as when a purge sequence is taking place or when gaseous fuel is not intentionally being supplied to the fuel supply component. After suitable data analysis, the stored results of such monitoring would be useful for detecting trends in gas concentrations for purposes of preventative maintenance.

The electronic device can be configured to ignore isolated instances where the concentration of the fuel inside the fuel supply component exceeds the predetermined level so that a warning notification is provided, or control of the fuel injection system is carried out, only on the basis of output signals compiled over two or more consecutive or non-consecutive fuel supplies.

The device can also be connected to the thermocouple at the tip of the fuel supply component if one is included.

The gas sensor can have high sensitivity and selectivity to a single gas (such as methane, for example), to a number of different gases (such as methane and nitrogen, for example) or to a particular mixture of gases (such as air, or a mixture of air and methane, for example). The gas sensor can be a mixed metal oxide semiconductor (MMOS) sensor. However, it will be readily appreciated that any suitable gas sensor can be used. MMOS sensors use the fact that adsorption of a gas onto the surface of a metal oxide semiconductor layer changes its conductivity to provide an output signal that is proportional to the concentration of the gas being adsorbed. Common oxides include $Cr_2TiO_3$, $WO_3$ and $SnO_2$. As well as being physically compact, MMOS sensors are reliable, accurate and have good response times. The response time is important because the gas sensor should be able to provide "real-time" monitoring so that action can be taken quickly to prevent ignition of any residual fuel.

An example of a compact gas sensor that is specifically designed for the detection of methane is the TGS 2611 sensor supplied by Figaro USA, Inc of Glenview, Ill., United States of America. The TGS 2611 sensor has a metal oxide semiconductor layer formed on an alumina substrate and incorporates an integral heater to maintain it at the optimum sensing temperature. The TGS 2611 sensor has a detection range of between 500 and 10,000 ppm.

Whereas the above paragraphs mention only a single fuel supply component fitted with a sensor, the invention also embraces a plurality of fuel supply components that undergo a purge sequence, and a corresponding plurality of gas sensors for detecting the concentration of the gaseous fuel inside the fuel supply components. In such systems, each fuel supply component is preferably provided with its own check valve through which it is connected to a common fuel manifold, thereby to prevent reverse flow of the gaseous fuel up the individual fuel lances and into the manifold. The fuel manifold is in turn connectable to a supply of gaseous fuel through a fuel supply valve and to a supply of purge gas through a purge gas supply valve.

In a further aspect, the invention includes a gas turbine engine comprising a burner and a fuel injection system as above for supplying gaseous fuel to the burner.

Additionally, the invention includes methods of monitoring the concentration of the gaseous fuel inside the fuel supply components of the above fuel injection systems.

Related aspects of the invention will be apparent from a perusal of the following description and claims.

BRIEF DESCRIPTION OF THE DRAWINGS

Exemplary embodiments of the invention will now be described, with reference to the accompanying drawings, in which:

FIG. 1 is a diagram of a typical purge sequence where a fuel lance is purged with nitrogen after a supply of fuel has been completed;

DETAILED DESCRIPTION OF THE PREFERRED EMBODIMENTS

Figure 1:
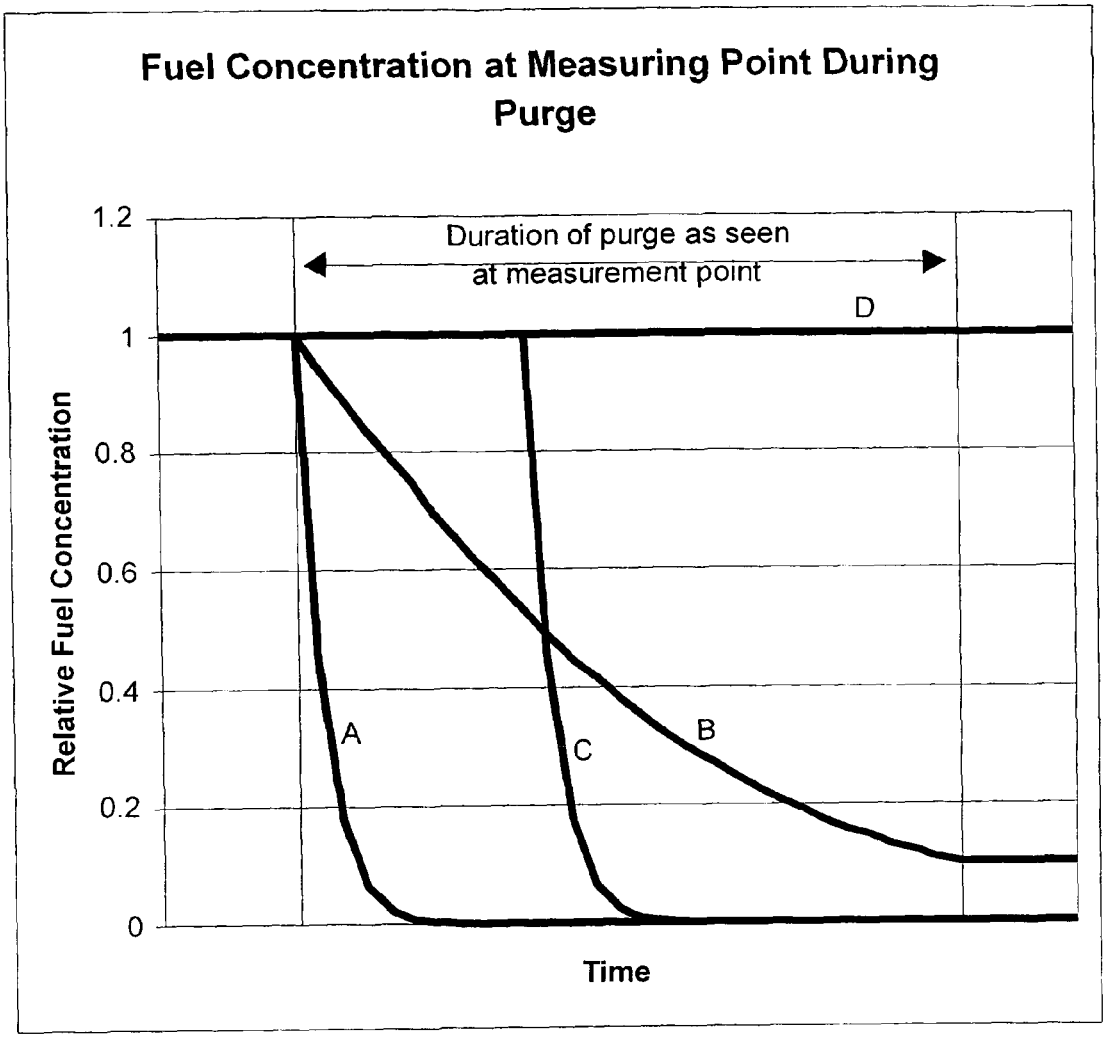
FIG. 1 illustrates

FIG. 1 shows a typical variation in fuel concentration at a point in a fuel lance during a nitrogen purge sequence. This purge sequence is initiated in the fuel injection system by simultaneously closing the fuel supply valve to the fuel manifold and opening the purge gas supply valve. The purge sequence is terminated by the closure of the purge gas supply valve. The four lines shown in FIG. 1 represent the relative fuel concentration versus time response for a fuel injection system as follows.

Line A All valves operating correctly.

Line B Insufficient purge gas flow due to problems such as one of the following:

(i) check valve that is operating poorly (partially blocked or not opening fully;

(ii) blocked or damaged fuel line; or (iii) incorrect operation of the overall purge gas flow.

Line C A check valve that has a tendency to stick during operation.

Line D A check valve that is stuck in the open position.

A similar relative fuel concentration versus time response, but showing reverse trends, can be expected when the fuel valve is opened to allow fuel to flow into the fuel manifold and then into to the fuel lances.

A further condition may arise if fuel is trapped in the fuel manifold after purging, either because the purge sequence itself was inadequate or because of leakage of the fuel supply valve. In normal circumstances any residual fuel trapped in the fuel manifold would not be passed to the fuel lances as the check valves would be closed. However, during load decrease, pressure differences between the fuel manifold and the combustion chamber upstream of the fuel lances may cause the check valves to open and allow fuel to be discharged from the fuel manifold past the check valves. This may be seen as in increase in fuel concentration in the fuel lances and could give rise to ignition.

If the fuel injection system is operating properly then the flow of fuel into the fuel manifold is stopped and the flow of purge gas is initiated. The purge gas can then flow freely into the fuel lances through the open check valves and the concentration of fuel inside each fuel lance, therefore, falls quickly to a very low level as the nitrogen displaces the residual fuel. There is no risk of ignition. Even if the check valve for a particular fuel lance has a tendency to stick during operation, the concentration of fuel inside the fuel lance will fall to a very low level as soon as the check valve eventually opens. Therefore, if the delay is relatively short compared to the duration of the purge sequence then there is not usually a problem. However, if the delay is such that the check valve for a particular fuel lance does not open until near the end of the purge sequence, or if the check valve does not open during the purge sequence at all, then purge gas will not flow into the fuel lance from the fuel manifold and there will be no reduction in the concentration of fuel inside the fuel lance during the purge sequence. There is a significant risk that a critical fuel air mixture will be reached and that ignition will occur.

If the check valve of a particular fuel lance is partially blocked or does not open fully then a reduced flow of purge gas will flow into the fuel lance from the fuel manifold resulting in a slower rate of reduction in the fuel concentration inside the fuel lance. If the flow is sufficiently reduced, then enough fuel may remain inside the fuel lance to cause a significant risk of ignition. Similar reductions in the flow of the purge gas could occur if the fuel lance were blocked or damaged. All the fuel lances connected to the fuel manifold would see a similar reduction in the flow of the purge gas if there were a problem with the purge gas supply.

The risk of ignition is greatest if a particular check valve does not open at all (for example, if it is blocked or needs to be repaired). In this case no purge gas will flow into the fuel lance from the fuel manifold and there is no reduction at all in the concentration of fuel inside the fuel lance during the purge sequence.

The measurement of the concentration of the fuel inside a particular fuel lance can provide an indication of when a critical fuel air mixture is reached or maintained due to an insufficient nitrogen purge. The rate of change of the concentration of the fuel inside the fuel lance can also be used to provide an indication of the operating condition of the check valve or changes in the effective area of the flow path of the fuel lance caused by a blockage or damage. For example, if the concentration of fuel inside the fuel lance stays at high levels for a period of the after the purge sequence has started, but then falls rapidly to a low level, it is likely that the check valve is sticking and it can be scheduled for maintenance or repair.

If rises in concentration as seen during periods when the fuel lance is not in operation then this can indicate problems such a fuel trapped in the fuel manifold being discharged through the check valve.

By providing, inter alia, a suitable gas sensor for detecting the concentration of the gaseous fuel inside the fuel supply lance, the present invention aims to take the above considerations into account.

Figure 2:
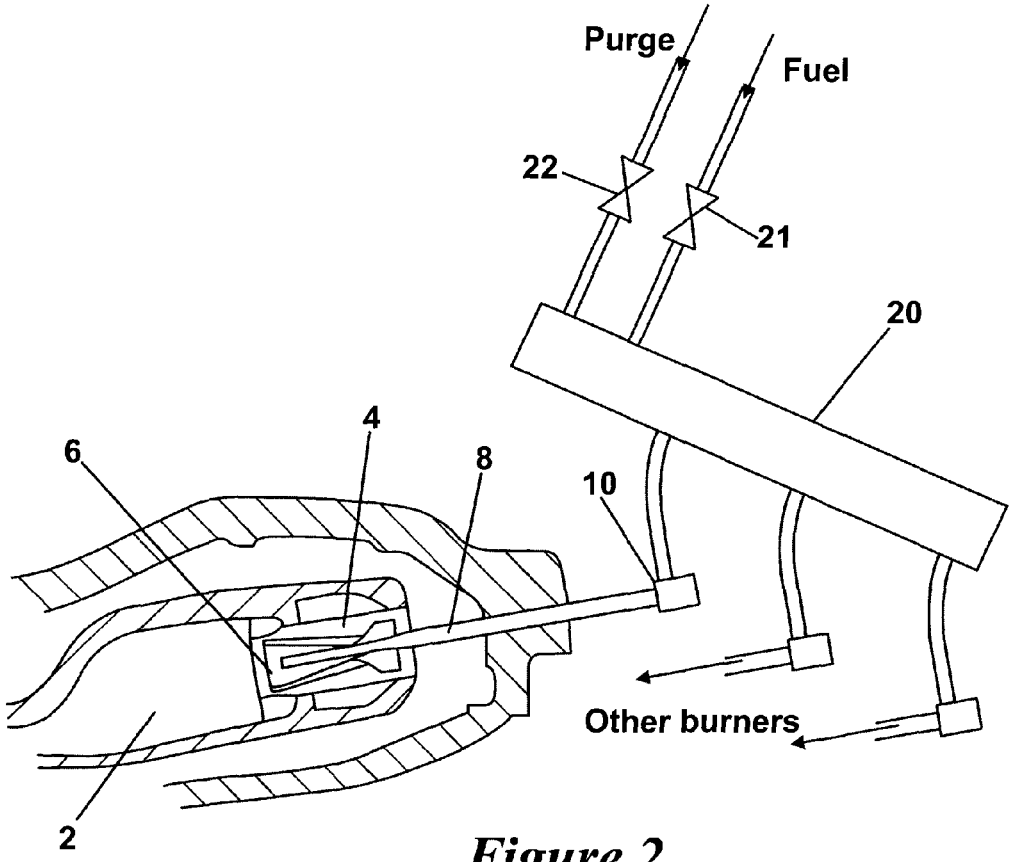
FIG. 2 is a radial cross section view of part of a gas turbine engine showing the combustion chamber, a burner and its associated fuel lance, fuel manifold and fuel and purge gas supplies.
Figure 3:
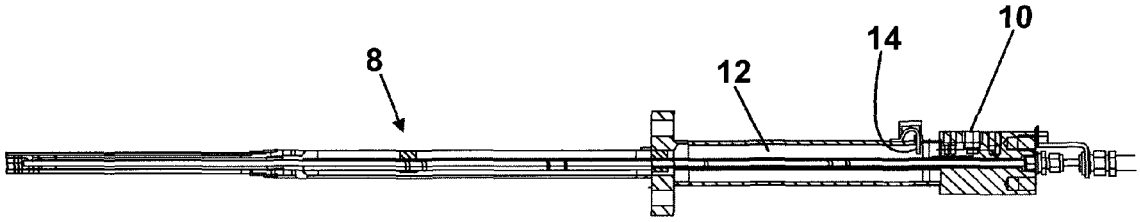
FIG. 3 is a side view of a fuel lance according to the present invention.
Figure 4:
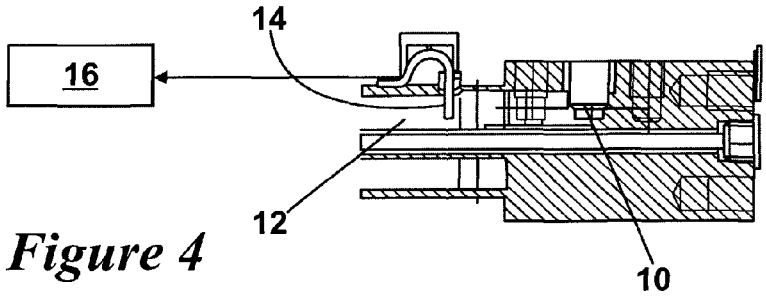
FIG. 4 is a detail view of the fuel lance of FIG. 3 showing the location of a gas sensor.

With reference to FIGS. 2 to 4, a gas turbine engine includes a combustion chamber 2. A burner 4 is arranged in the plenum of the gas turbine engine and has an inner injection space 6 that is open to the combustion chamber 2. A fuel lance 8 has a tip that extends into the injection space 6. Methane fuel is supplied periodically through the pilot fuel lance 8 and into the injection space 6 where it is mixed with compressed air from a compressor stage (not shown) of the gas turbine engine and ignited. A second fuel supply (not shown) injects fuel into the injection space 6 to support combustion when the pilot fuel lance 8 is not operating.

A number of individual fuel lances are supplied with fuel from a fuel manifold 20. Each fuel lance is connected to the fuel manifold 20 via a check valve 10 that prevents reverse flow from the fuel lance back into the fuel manifold 20. A fuel valve 21 and a purge gas valve 22 can be opened and closed to control the flow of methane fuel and purge gas to the burner 4 through the gas pilot channel 12. A mixed metal oxide semiconductor (MMOS) sensor 14 is located in the gas pilot channel 12 near to the outlet of the check valve 10. The MMOS sensor 14 is connected to an electronic device 16 and provides an output signal that is used by the electronic device to monitor the concentration of methane fuel in the gas pilot channel 12 at all times during the operation of the gas turbine engine. The rate of change of the concentration of methane fuel is also monitored.

After a supply of methane fuel has been completed, the fuel lance 8 is purged with nitrogen to flush out any residual methane fuel. The concentration of the methane fuel in the gas pilot channel 12 is detected by the MMOS sensor 14 and monitored by the electronic device 16. If the flow of purge gas is adequate, the concentration of the methane fuel inside the gas pilot channel 12 will fall quickly to a very low level. There is no risk at all of ignition and the electronic device 16 does not need to take any action to prevent overheating. However, if the flow of purge gas is not adequate, due for example to a faulty check valve 10, or for any other reason, then the concentration of methane fuel may not fall as quickly, or be reduced to acceptable levels during the purge sequence. The gas pilot channel 12 may therefore still contain a significant concentration of methane fuel when the purge sequence is complete. In this situation, the electronic device 16 may take action to reduce the risk of overheating caused by the ignition of the methane fuel inside the fuel lance 8. The electronic device 16 can generate an audible or visual warning to alert a controller or operator that the purge sequence has not been effective. Alternatively, the electronic device 16 can control the purge valve 22 to extend the purge sequence to bring the concentration of the methane fuel back to safe levels. In very serious cases the electronic device 16 can shut down the gas turbine engine completely.

By routinely monitoring the rate of change of the concentration of the methane fuel inside the fuel lance 8, the electronic device 16 can provide an indication of the operating condition of the fuel lance 8 and/or the check valve 10. In many cases the problem may not be sufficient to allow the concentration of the methane fuel to reach dangerous levels. However, any fuel lance 8 and/or check valve 10 that is not operating within specified limits can be scheduled for maintenance and repair.

Additionally, the outputs from the sensors located in each of the fuel lances can be compared to determine whether any deviation from specified limits were due to a problem with the purge gas supply, or due to a problem with a specific fuel lance and/or check valve. The former would result in the same characteristic output from all of the sensors and the latter would result in individual sensors showing an inadequate reduction in fuel concentration for the associated fuel lance and/or check valve that is at fault. This may result in different warning, alarms or actions from the electronic device 16 depending on the particular circumstances.

The present invention has been described above purely by way of example, and modifications can be made within the scope of the invention as claimed. The invention also consists in any individual features described or implicit herein or shown or implicit in the drawings or any combination of any such features or any generalisation of any such features or combination, which extends to equivalents thereof. Thus, the breadth and scope of the present invention should not be limited by any of the above-described exemplary embodiments. Each feature disclosed in the specification, including the claims and drawings, may be replaced by alternative features serving the same, equivalent or similar purposes, unless expressly stated otherwise.

Any discussion of the prior art throughout the specification is not an admission that such prior art is widely known or forms part of the common general knowledge in the field.

Unless the context clearly requires otherwise, throughout the description and the claims, the words "comprise", "comprising", and the like, are to be construed in an inclusive as opposed to an exclusive or exhaustive sense; that is to say, in the sense of "including, but not limited to".

I claim:

1. A fuel injection system for supplying fuel to a combustion chamber constituting part of a gas turbine engine, comprising:

a fuel lance constituting part of a burner and connectable to a supply of gaseous fuel and to a supply of purge gas, the fuel lance having an internal gas channel through which the gaseous fuel is supplied to the combustion chamber during combustion, and through which the purge gas is supplied to remove any residual gaseous fuel during a purge sequence; and a gas sensor for sensing concentration of the gaseous fuel inside the internal gas channel of the fuel lance, and for generating an output signal indicative of said concentration.

2. The fuel injection system according to claim 1, and a check valve inside the internal gas channel of the fuel lance for preventing reverse flow of the gaseous fuel and the purge gas through the internal gas channel to the supplies.

3. The fuel injection system according to claim 2, wherein the fuel lance is connectable to the supply of gaseous fuel and to the supply of purge gas through a manifold, wherein the gas sensor is located in the internal gas channel, and wherein the check valve is located adjacent the gas sensor and prevents the reverse flow to the manifold.

4. The fuel injection system according to claim 1, and an electronic device for processing the output signal to monitor operation of the fuel injection system based on said concentration.

5. The fuel injection system according to claim 1, and an electronic device for processing the output signal to monitor operation of the fuel injection system based on a rate of change of said concentration.

6. The fuel injection system according to claim 1, and an electronic device for processing the output signal to monitor operation of the fuel injection system, and for generating a warning signal when said concentration exceeds a predetermined level.

7. The fuel injection system according to claim 1, wherein the gas sensor is a mixed metal oxide semiconductor (MMOS) sensor.

8. A fuel injection system for supplying fuel to a common combustion chamber constituting part of a gas turbine engine, comprising:

a plurality of fuel lances each constituting part of a burner and connectable to a common supply of gaseous fuel and to a common supply of purge gas, each fuel lance having an internal gas channel through which the gaseous fuel is supplied to the common combustion chamber during combustion, and through which the purge gas is supplied to remove any residual gaseous fuel during a purge sequence; and a corresponding plurality of gas sensors each operative for sensing concentration of the gaseous fuel inside the internal gas channel of a respective fuel lance, and for generating an output signal indicative of said concentration.

9. The fuel injection system according to claim 8, wherein the fuel lances are connected to the common supplies through a common manifold; and a corresponding plurality of check valves each mounted inside the internal gas channel of the respective fuel lance for preventing reverse flow of the gaseous fuel and the purge gas through the internal gas channel to the common manifold.

10. The fuel injection system according to claim 9, and a fuel supply valve mounted between the common manifold and the common supply of gaseous fuel, and a purge gas supply valve mounted between the common manifold and the common supply of purge gas.

11. A method of monitoring a fuel injection system connected to a combustion chamber constituting part of a gas turbine engine, comprising the steps of:

connecting a fuel lance constituting part of a burner and having an internal gas channel to a supply of gaseous fuel and to a supply of purge gas;

supplying the gaseous fuel through the internal gas channel to the combustion chamber during combustion;

supplying the purge gas through the internal gas channel to remove any residual gaseous fuel during a purge sequence;

sensing concentration of the gaseous fuel inside the internal gas channel of the fuel lance; and generating an output signal indicative of said concentration.

12. The method according to claim 11, further comprising the step of processing the output signal to generate a warning signal when said concentration exceeds a predetermined level.

13. The method according to claim 11, further comprising the step of processing the output signal to control operation of the fuel injection system when said concentration exceeds a predetermined level.

14. The method according to claim 11, wherein the sensing step is continuously performed.

15. The method according to claim 11, wherein the sensing step is performed at regular intervals.

16. The method according to claim 11, wherein the sensing step is performed during the purge sequence.

17. The method according to claim 11, wherein the sensing step is performed during a period when the gaseous fuel is not intentionally supplied to the combustion chamber.

18. The method according to claim 11, further comprising the step of processing the output signal to monitor a rate of change of said concentration.

19. The method according to claim 18, wherein the processing step is performed by generating a warning signal when the rate of change of said concentration exceeds a predetermined level.

20. The method according to claim 18, wherein the processing step is performed by controlling operation of the fuel injection system when the rate of change of said concentration exceeds a predetermined level.

21. The method according to claim 18, wherein the processing step is performed by using at least one of said concentration and the rate of change of said concentration to determine an operating condition of the fuel injection system.

22. The method according to claim 18, and the step of preventing reverse flow of the gaseous fuel by mounting a check valve in the internal gas channel, and wherein the processing step is performed by using at least one of said concentration and the rate of change of said concentration to determine an operating condition of the check valve.

23. A method of monitoring a fuel injection system connected to a common combustion chamber constituting part of a gas turbine engine, comprising the steps of:

connecting a plurality of fuel lances each constituting part of a burner and having an internal gas channel to a common supply of gaseous fuel and to a common supply of purge gas;

supplying the gaseous fuel through the internal gas channel of each fuel lance to the common combustion chamber during combustion;

supplying the purge gas through the internal gas channel of each fuel lance to remove any residual gaseous fuel during a purge sequence;

sensing concentration of the gaseous fuel inside the internal gas channel of each fuel lance; and generating an output signal indicative of said concentration within the internal gas channel of each fuel lance.

24. The method according to claim 23, further comprising the step of generating a warning signal when said concentration inside at least one of the fuel lances exceeds a predetermined level.

25. The method according to claim 23, further comprising the step of generating a warning signal by comparing said respective concentrations inside the plurality of the fuel lances.

26. The method according to claim 23, further comprising the step of processing the output signal for each fuel lance to monitor a rate of change of each concentration inside each fuel lance.

27. The method according to claim 26, further comprising the step of using at least one of said concentration and the rate of change of said concentration inside at least one of the fuel lances to determine an operating condition of the fuel injection system.

28. The method according to claim 26, further comprising the step of preventing reverse flow of the gaseous fuel by mounting a check valve in each internal gas channel, and wherein the processing step is performed by using at least one of said concentration and the rate of change of said concentration inside at least one of the fuel lances to determine an operating condition of the check valve in each internal gas channel.

* * * * *